US008575998B2

(12) United States Patent
Huang et al.

(10) Patent No.: US 8,575,998 B2
(45) Date of Patent: Nov. 5, 2013

(54) VOLTAGE REFERENCE CIRCUIT WITH TEMPERATURE COMPENSATION

(75) Inventors: Ming-Chieh Huang, San Jose, CA (US); Tien-Chun Yang, San Jose, CA (US); Steven Swei, Fremont, CA (US)

(73) Assignee: Taiwan Semiconductor Manufacturing Company, Ltd. (TW)

( * ) Notice: Subject to any disclaimer, the term of this patent is extended or adjusted under 35 U.S.C. 154(b) by 399 days.

(21) Appl. No.: 12/825,652

(22) Filed: Jun. 29, 2010

(65) Prior Publication Data

US 2011/0001557 A1 Jan. 6, 2011

Related U.S. Application Data

(60) Provisional application No. 61/222,852, filed on Jul. 2, 2009.

(51) Int. Cl.
*G05F 1/10* (2006.01)
*G05F 3/02* (2006.01)

(52) U.S. Cl.
USPC ..... 327/541; 323/315

(58) Field of Classification Search
USPC ..... 327/539–541; 323/313–316
See application file for complete search history.

(56) References Cited

U.S. PATENT DOCUMENTS 6,201,381 B1 * 3/2001 Yasuda ..... 323/315
2006/0279269 A1 * 12/2006 Yang ..... 323/313

* cited by examiner

*Primary Examiner* — Lincoln Donovan
*Assistant Examiner* — Diana J Cheng
(74) *Attorney, Agent, or Firm* — Lowe Hauptman & Ham, LLP

(57) ABSTRACT

A voltage reference circuit with temperature compensation includes a power supply, a reference voltage supply, a first PMOS transistor with its source connected to the power supply voltage, a second PMOS transistor with its source connected to the power supply and its gate and drain connected to the first PMOS gate, a first NMOS transistor with its gate and drain connected the first PMOS drain, a second NMOS transistor with its drain connected to the second PMOS drain and its gate connected with the first NMOS gate to the reference voltage supply, a resistor connected to the second NMOS source and ground, and an op-amp with its inverting input and its output connected the first NMOS source and its non-inverting input connected to the ground. In another aspect, a voltage reference circuit output is coupled to an NMOS gate in saturation mode connected to another voltage reference circuit.

20 Claims, 6 Drawing Sheets

VOLTAGE REFERENCE CIRCUIT WITH TEMPERATURE COMPENSATION

CROSS-REFERENCE TO RELATED APPLICATIONS

The present application claims priority of U.S. Provisional Patent Application Ser. No. 61/222,852, filed on Jul. 2, 2009, which is incorporated herein by reference in its entirety.

TECHNICAL FIELD

This invention relates generally to a voltage reference circuit, more specifically a voltage reference circuit with temperature compensation for constant transconductance (Gm) design.

BACKGROUND

A voltage reference circuit is an electronic device (circuit or component) that produces a fixed (constant) voltage irrespective of the loading on the device, process, power supply variation and temperature. A voltage reference circuit is one of important analog blocks in integrated circuits.

One common voltage reference circuit used in integrated circuits is the bandgap voltage reference circuit. A bandgap-based reference circuit uses analog circuits to add a multiple of the voltage difference between two bipolar junctions biased at different current densities to the voltage developed across a diode. The diode voltage has a negative temperature coefficient (i.e. it decreases with increasing temperature), and the junction voltage difference has a positive temperature coefficient. When added in the proportion required to make these coefficients cancel out, the resultant constant value is a voltage equal to the bandgap voltage of the semiconductor. However, the bandgap design requires relatively large area and power.

Another voltage reference circuit design is a constant transconductance (Gm) design.

FIG. 1A is a schematic diagram of a conventional constant Gm voltage reference circuit without temperature compensation. Two PMOS transistors 102 and 104 that are connected to VDD share the gate connections. NMOS transistors 106 and 108 are connected to PMOS transistors 102 and 104 and share the gate connections to the output voltage VREF, while the gate and drain of PMOS 104 are connected together and the gate and drain of NMOS 106 are connected together. The NMOS channel size ratio of 106 and 108 are W/L:K(W/L) =1:K, where W/L is the width over length of the channel of the NMOS transistors. The source of NMOS 106 is connected to ground (VSS) and the source of NMOS 108 is connected to ground (VSS) through resistor Rs 110. Constant Gm design requires relatively small area and power, but suffers from a strong temperature dependence.

With $V_{TH}$ as the threshold voltage of NMOS 108, the current and voltage of the voltage reference circuit shown in FIG. 1A are given by the following equations:

$$Iref = \frac{2}{\mu_N C_{OX}\left(\frac{W}{L}\right)_N * Rs^2}\left(1 - \frac{1}{\sqrt{K}}\right)^2 \quad \text{(Eq. 1)}$$

-continued $$VREF = V_{TH} + \sqrt{\frac{2I_{ref}}{\mu_N C_{ox} K\left(\frac{W}{L}\right)_N}} + I_{ref} R_S, \quad \text{(Eq. 2)}$$

where $\mu_N$ is the mobility of the NMOS, $C_{ox}$ is the gate oxide capacitance, W/L is the width over length of the channel of the NMOS.

With increasing temperature, the mobility $\mu_N$ decreases, therefore results in higher Iref in Eq. 1. On the other hand, with increasing temperature, the threshold voltage $V_{TH}$ decreases, resulting in lower VREF in Eq. 2. Therefore VREF shows strong dependency on temperature. For example, compared to an exemplary bandgap design voltage reference circuit with a layout area of 77×53 $\mu m^2$ and 180 μA current requirement that showed about 3 mV variation over −40° C.-125° C., an exemplary constant Gm design voltage reference circuit with a layout area of 24×7.3 $\mu m^2$ and 10 μA current requirement showed a temperature variation of 18 mV over the same temperature range, as shown in FIG. 1B (a temperature vs. voltage output plot for an exemplary voltage reference circuit shown in FIG. 1A).

Accordingly, new temperature compensation schemes are desired for voltage reference with constant Gm design.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

A voltage reference circuit with temperature compensation for constant Gm design is provided. Throughout the various views and illustrative embodiments of the present invention, like reference numbers are used to designate like elements.

Figure 2A:
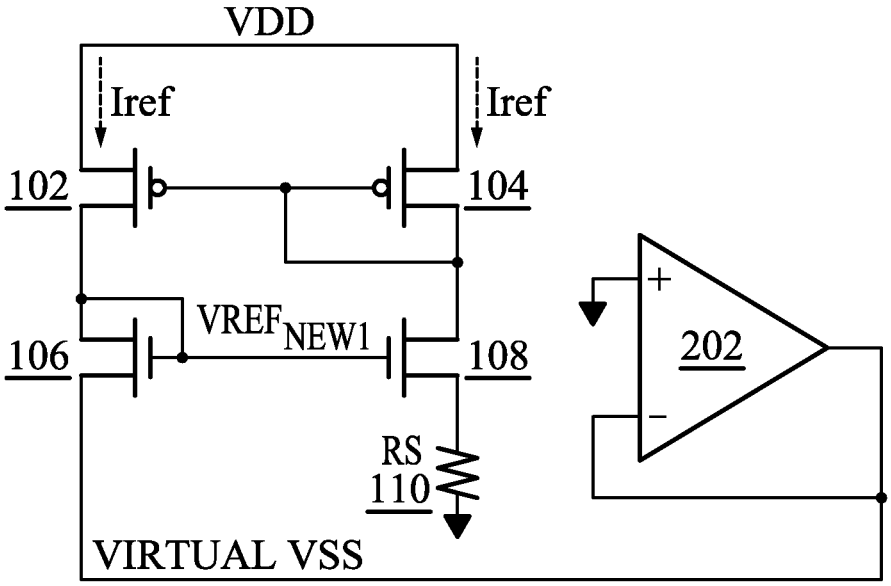
FIG. 2A is a schematic diagram of an exemplary voltage reference circuit with temperature compensation for constant Gm design according to one aspect of the invention.

FIG. 2A is a schematic diagram of an exemplary voltage reference circuit with temperature compensation for constant Gm design according to one aspect of the invention. An op amp 202 output coupled to the inverting input is connected to the source of the NMOS 106 (VirtualVSS). The non-inverting input of the op amp 202 is connected to the ground (VSS). Ideally, an op amp has infinite open loop gain, and zero output resistance. However, real op amps have limited gain and non-zero output resistance. The op amp 202 has a limited gain that can be adjustable.

With $V_{TH}$ as the threshold voltage of NMOS 108, the relationship between $VREF_{NEW1}$ and VirtualVSS can be expressed as the following:

$$VREF_{NEW1} - VirtualVSS = \sqrt{\frac{2I_{out}}{\mu_N C_{ox} K\left(\frac{W}{L}\right)_N}} + I_{ref} R_S + V_{TH}, \quad \text{(Eq. 3)}$$

where $$I_{ref} R_S = \sqrt{\frac{2I_{ref}}{\mu_N C_{ox}\left(\frac{W}{L}\right)_N}}\left(1 - \frac{1}{\sqrt{K}}\right)$$

Therefore, $$VREF_{NEW1} = (VirtualVSS) + \left(V_{TH} + \sqrt{\frac{2I_{ref}}{\mu_N C_{ox}\left(\frac{W}{L}\right)_N}}\right) \quad \text{(Eq. 4)}$$

In Eq. 4, the first term VirtualVSS increases with temperature increase because the limited gain op amp 202 cannot keep the VirtualVSS level to the ground as Iref in Eq. 1 increases. The second term in Eq. 4 decreases with temperature increase because of the threshold voltage $V_{TH}$ drop. As a result, $VREF_{NEW1}$ has small temperature variation since the first term in Eq. 4 (VirtualVSS) increases with temperature and the second term decreases with temperature. The gain of op amp 202 can be adjusted to find desired performance for temperature compensation.

In one integrated circuit embodiment, the current Iref was set to 5 μA, the NMOS transistor size ratio was 1:K=1:4 (K is a number greater than 1), and the resistance Rs was 8 kΩ. In other embodiments, the current Iref can range over 2-10 μA, K=4-16, Rs=1-40 kΩ. However, the circuit can be designed with different values without departing from the spirit and scope of the invention.

Figure 1A:
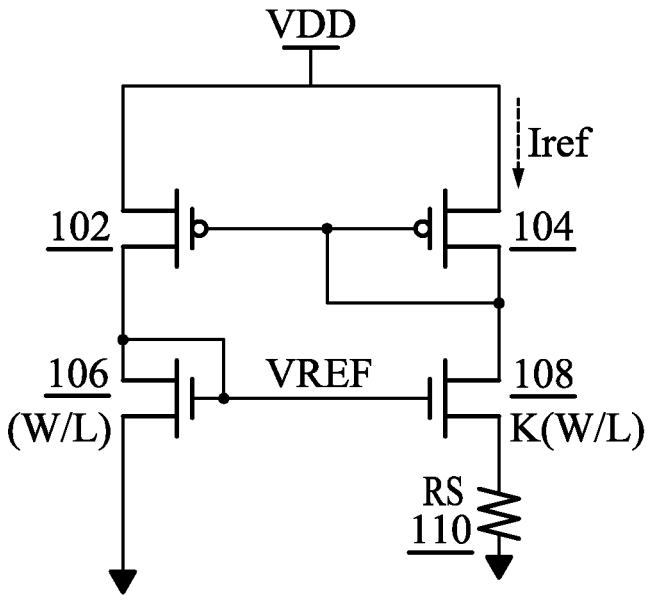
FIG. 1A ( PRIOR ART )
FIG. 1A is a schematic diagram of a conventional constant Gm voltage reference circuit without temperature compensation.
Figure 1B:
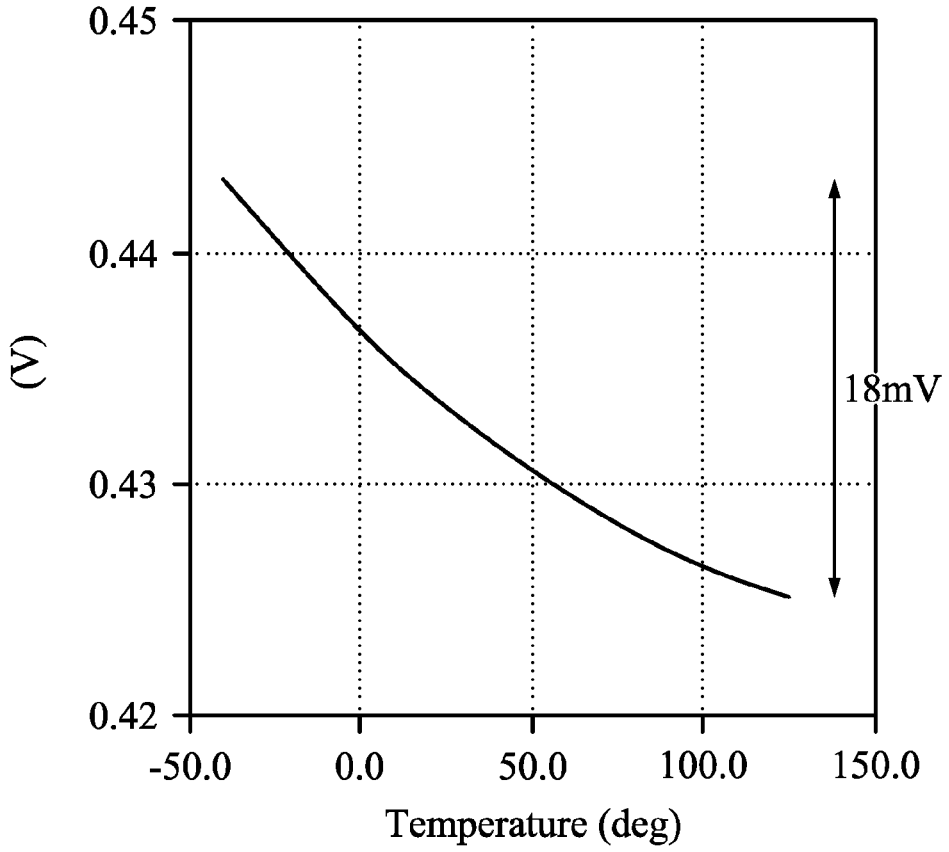
FIG. 1B is a temperature vs. voltage output plot for an exemplary voltage reference circuit shown in FIG. 1A.
Figure 2B:
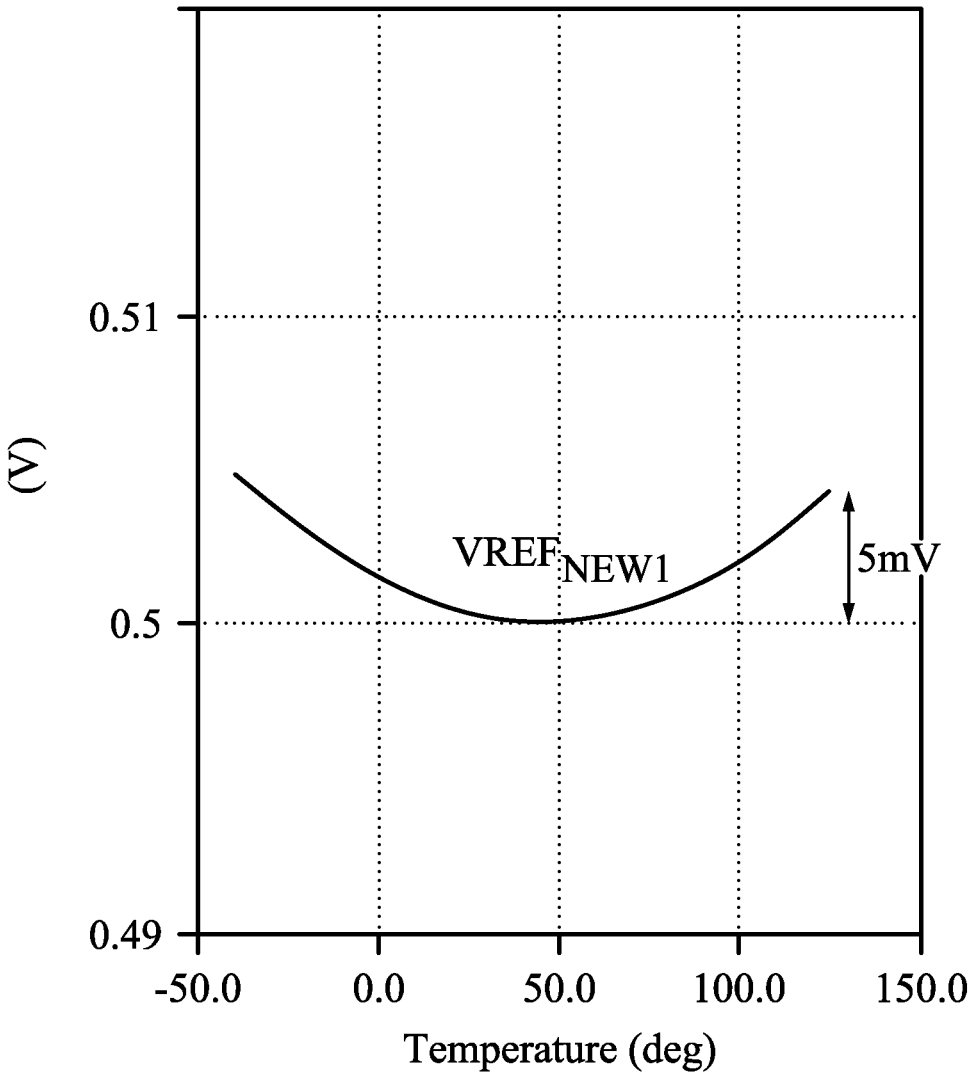
FIG. 2B is a temperature vs. voltage output plot for an embodiment of the voltage reference circuit shown in FIG. 2A.

FIG. 2B is a temperature vs. voltage output plot for an embodiment of the voltage reference circuit shown in FIG. 2A. It shows 5 mV variation over the temperature range of −40° C.-125° C., a big improvement compared to the voltage reference circuit without temperature compensation in FIG. 1A that showed 18 mV variation as shown in FIG. 1B.

Figure 3A:
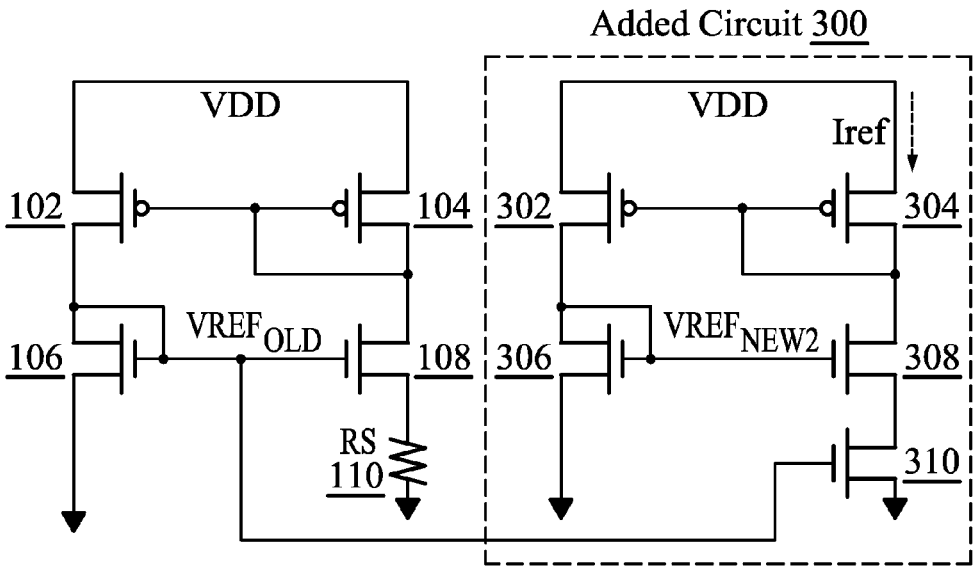
FIG. 3A is a schematic diagram of an exemplary voltage reference circuit with temperature compensation for constant Gm design according to another aspect of the invention.

FIG. 3A is a schematic diagram of an exemplary voltage reference circuit with temperature compensation for constant Gm design according to another aspect of the invention. In this scheme, the VREF from a constant Gm voltage reference on the left is connected to the gate of an NMOS 310 of the added circuit 300 on the right side. The added circuit 300 is similar to the constant Gm voltage reference circuit shown on the left side, but has the NMOS 310 in place of Rs 110 in the constant Gm voltage reference circuit. By connecting the VREF on the left side circuit to the gate of NMOS 310 on the right side, the VREF decrease with temperature increase can be compensated by the increasing source-gate resistance of the NMOS 310.

With $R_{TX}$ as the source-gate resistance of NMOS 310, the output voltage is given by the following:

$$VREF_{NEW2} = V_{TH2} + \sqrt{\frac{2I_{out}}{\mu_N C_{ox} K\left(\frac{W}{L}\right)_N}} + I_{ref} R_{TX} \quad \text{(Eqs. 5 and 6)}$$

$$R_{TX} = \frac{\partial V_{GS}}{\partial I_D} = \frac{1}{\mu_N C_{ox}\left(\frac{W}{L}\right)(V_{GS} - V_T)}$$

With increasing temperature, the decreasing VREF from the left side circuit biases the NMOS 310 gate, thus increasing the resistance of NMOS 310, $R_{TX}$. The advantage of this scheme includes simple implementation for robustness by adding a similar circuit to the voltage reference design. The size of NMOS 310 can be designed to have a desired resistance $R_{TX}$.

In one integrated circuit embodiment, the current Iref was set to 5 μA, the NMOS transistor size proportion ratio was 1:N=1:4 (N is a number greater than 1) between NMOS transistors 106 and 108 and/or 306 and 308, the resistance Rs was 8 kΩ, and the source-drain resistance Rds of NMOS transistor 310 was 8 kΩ. In other embodiments, the current Iref can range from 2-10 μA, N=4-16, Rs=1-40 kΩ, and Rds=1-40 kΩ. However, the circuit can be designed with different values without departing from the spirit and scope of the invention.

Figure 3B:
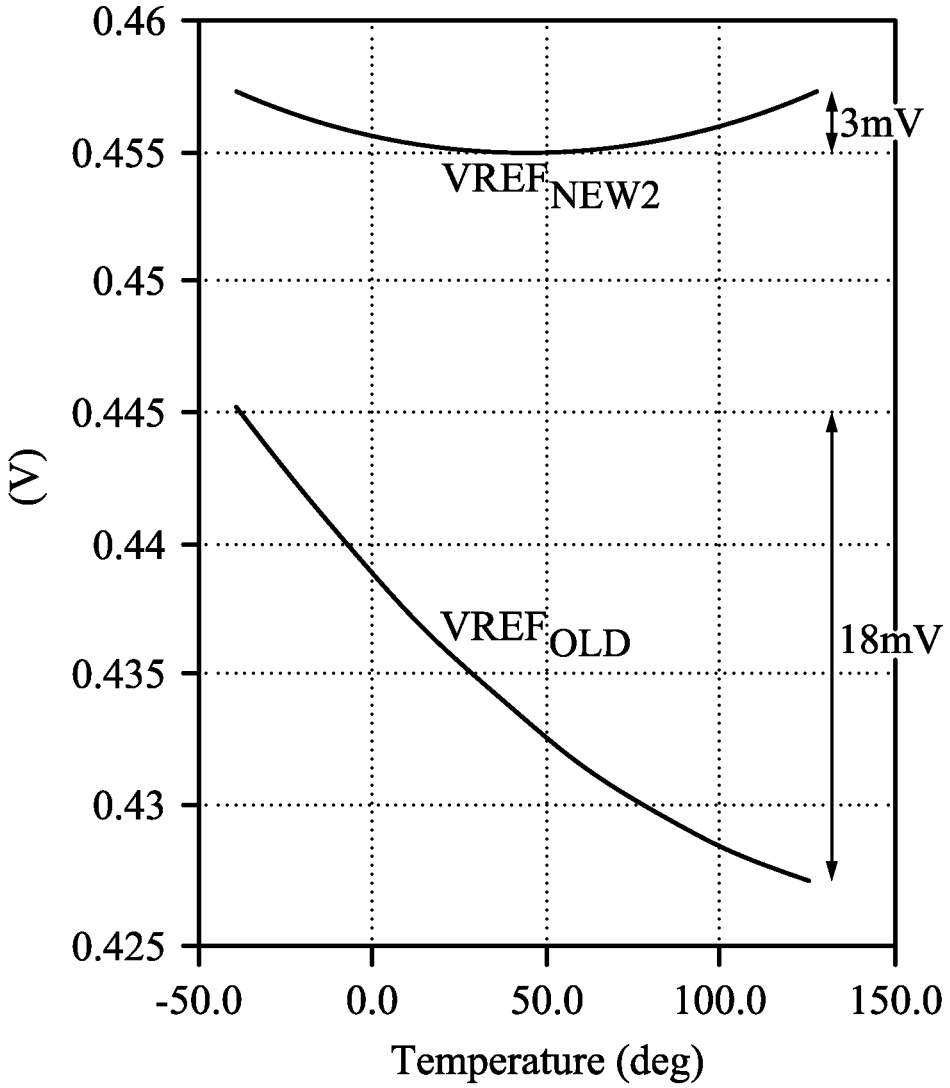
FIG. 3B is a temperature vs. voltage output plot for an embodiment of the voltage reference circuit shown in FIG. 3A.

FIG. 3B is a temperature vs. voltage output plot for an embodiment of the voltage reference circuit shown in FIG. 3A. The temperature variation of $VREF_{OLD}$ over −40° C.-125° C. was 18 mV, but the temperature compensated $VREF_{NEW2}$ varied only 3 mV.

Therefore, a constant Gm voltage reference that requires very small size and power compared to a bandgap design can be achieved with much improved accuracy of the output voltage by adding a temperature compensation feedback element that can control the voltage variation. A skilled person in the art will appreciate that there can be many variations of these embodiments.

Although the present embodiments and its advantages have been described in detail, it should be understood that various changes, substitutions and alterations can be made herein without departing from the spirit and scope of the appended claims. As one of ordinary skill in the art will readily appreciate from the disclosure of the present embodiments, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A voltage reference circuit with temperature compensation, comprising:

a power supply;

a reference voltage supply;

a first PMOS transistor with a source connected to the power supply;

a second PMOS transistor with a source connected to the power supply and a gate and a drain connected together to the gate of the first PMOS;

a first NMOS transistor with a gate and a drain connected together to the drain of the first PMOS transistor;

a second NMOS transistor with a drain connected to the drain of the second PMOS transistor and a gate connected together with the gate of the first NMOS transistor to the reference voltage supply;

a resistor connected to the source of the second NMOS transistor and ground; and an op-amp having one inverting input, one non-inverting input, and an op-amp output, wherein the op-amp inverting input and the op-amp output are connected together to the source of the first NMOS transistor, and the op-amp non-inverting input is connected to the ground.

2. The voltage reference circuit of claim 1, wherein the op-amp has a limited gain configured to be adjustable.

3. The voltage reference circuit of claim 1, wherein the first NMOS transistor and the second NMOS transistor have a size proportion ratio of 1:K, wherein the size proportion is defined as a width over a length of a channel of a transistor and K is a number greater than 1.

4. The voltage reference circuit of claim 3, wherein K ranges 4-6.

5. The voltage reference circuit of claim 3, wherein K ranges from 4 to 16.

6. The voltage reference circuit of claim 1, wherein the resistor has a resistance ranging 1-40 kΩ.

7. The voltage reference circuit of claim 1, wherein the reference voltage supply is expressed by:

$$VREF_{NEW1} = (VirtualVSS) + \left(V_{TH} + \sqrt{\frac{2I_{ref}}{\mu_N C_{ox}\left(\frac{W}{L}\right)_N}}\right)$$

where $VREF_{NEW1}$ is the reference voltage supply, VirtualVSS is the op-amp output, $V_{TH}$ is the threshold voltage of the second NMOS transistor, $I_{ref}$ is the reference current of the voltage reference circuit, $\mu_N$ is the mobility of the second NMOS transistor, $C_{ox}$ is the gate oxide capacitance of the second NMOS transistor, W is the width of the channel of the second NMOS transistor, L is the length of the channel of the second NMOS transistor and N is an integer greater than 1.

8. A voltage reference circuit with temperature compensation, comprising:

a power supply;

a reference voltage supply;

a first PMOS transistor with a source connected to the power supply;

a second PMOS transistor with a source connected to the power supply and a gate and a drain connected together to the gate of the first PMOS;

a first NMOS transistor with a gate and a drain connected together to the drain of the first PMOS transistor;

a second NMOS transistor with a drain connected to the drain of the second PMOS transistor and a gate connected together with the gate of the first NMOS transistor to the reference voltage supply;

a resistor connected to the source of the second NMOS transistor and ground; and an op-amp having one inverting input, one non-inverting input, and an op-amp output, wherein the op-amp inverting input and the op-amp output are connected together to the source of the first NMOS transistor, the op-amp non-inverting input is connected to the ground, the op-amp has an adjustable gain.

9. The voltage reference circuit of claim 8, wherein the first NMOS transistor and the second NMOS transistor have a size proportion ratio of 1:K, wherein the size proportion is defined as a width over a length of a channel of a transistor and K is a number greater than 1.

10. The voltage reference circuit of claim 9, wherein K ranges 4-16.

11. The voltage reference circuit of claim 8, wherein the resistor has a resistance ranging 1-40 kΩ.

12. The voltage reference circuit of claim 8, wherein the reference voltage supply is expressed by:

$$VREF_{NEW1} = (VirtualVSS) + \left(V_{TH} + \sqrt{\frac{2I_{ref}}{\mu_N C_{ox}\left(\frac{W}{L}\right)_N}}\right)$$

where $VREF_{NEW1}$ is the reference voltage supply, VirtualVSS is the op-amp output, $V_{TH}$ is the threshold voltage of the second NMOS transistor, $I_{ref}$ is the reference current of the voltage reference circuit, $\mu_N$ is the mobility of the second NMOS transistor, $C_{ox}$ is the gate oxide capacitance of the second NMOS transistor, W is the width of the channel of the second NMOS transistor, L is the length of the channel of the second NMOS transistor and N is an integer greater than 1.

13. The voltage reference circuit of claim 12, wherein the reference current ranges from 2 microAmps (μA) to 10 μA.

14. A voltage reference circuit with temperature compensation, comprising:

a power supply;

a reference voltage supply;

a first PMOS transistor with a source connected to the power supply;

a second PMOS transistor with a source connected to the power supply and a gate and a drain connected together to the gate of the first PMOS;

a first NMOS transistor with a gate and a drain connected together to the drain of the first PMOS transistor;

a second NMOS transistor with a drain connected to the drain of the second PMOS transistor and a gate connected together with the gate of the first NMOS transistor to the reference voltage supply;

a resistor connected to the source of the second NMOS transistor and ground; and an op-amp having one inverting input, one non-inverting input, and an op-amp output, wherein the op-amp inverting input and the op-amp output are connected together to the source of the first NMOS transistor, and the op-amp non-inverting input is connected to the ground, wherein the reference voltage supply is expressed by:

$$VREF_{NEW1} = (VirtualVSS) + \left(V_{TH} + \sqrt{\frac{2I_{ref}}{\mu_N C_{ox}\left(\frac{W}{L}\right)_N}}\right)$$

where $VREF_{New1}$ is the reference voltage supply, VirtualVSS is the op-amp output, $V_{TH}$ is the threshold voltage of the second NMOS transistor, $I_{ref}$ is the reference current of the voltage reference circuit, $\mu_N$ is the mobility of the second NMOS transistor, $C_{ox}$ is the gate oxide capacitance of the second NMOS transistor, W is the width of the channel of the second NMOS transistor, L is the length of the channel of the second NMOS transistor and N is an integer greater than 1.

15. The voltage reference circuit of claim 14, wherein the op-amp has an adjustable gain.

16. The voltage reference circuit of claim 14, wherein the first NMOS transistor and the second NMOS transistor have a size proportion ratio of 1:K, wherein the size proportion is defined as a width over a length of a channel of a transistor and K is a number greater than 1.

17. The voltage reference circuit of claim 16, wherein K ranges from 4 to 16.

18. The voltage reference circuit of claim 14, wherein the resistor has a resistance ranging 1-40 kΩ.

19. The voltage reference circuit of claim 14, wherein the reference current of the voltage reference circuit is expressed by:

$$I_{ref} R_S = \sqrt{\frac{2I_{ref}}{\mu_N C_{ox}\left(\frac{W}{L}\right)_N}}\left(1 - \frac{1}{\sqrt{K}}\right).$$

20. The voltage reference circuit of claim 14, wherein the reference current ranges from 2 microAmps (μA) to 10 μA.

* * * * *